US005295600A

United States Patent [19]

Kowal

[11] Patent Number: 5,295,600

[45] Date of Patent: Mar. 22, 1994

[54] TAMPER INDICATING CLOSURE

[75] Inventor: Timothy B. Kowal, Maumee, Ohio

[73] Assignee: Owens-Illinois Closure Inc., Toledo, Ohio

[21] Appl. No.: 22,240

[22] Filed: Feb. 25, 1993

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,904,062 | 9/1975 | Grussen . | |
| 4,033,472 | 7/1977 | Alchinger . | |
| 4,205,755 | 6/1980 | de Wijn . | |
| 4,458,821 | 7/1984 | Ostrowsky . | |
| 4,530,436 | 7/1985 | Wiedmer . | |
| 4,545,496 | 10/1985 | Wilde . | |
| 4,613,052 | 9/1986 | Gregory . | |
| 4,666,053 | 5/1987 | Corcoran . | |
| 4,720,018 | 1/1988 | Schetzsle . | |
| 4,721,218 | 1/1988 | Gregory . | |
| 4,801,030 | 1/1989 | Barriac . | |
| 4,801,031 | 1/1989 | Barriac . | |
| 4,978,016 | 12/1990 | Hayes . | |
| 5,056,675 | 10/1991 | Julian | 215/252 |
| 5,080,246 | 1/1992 | Hayes . | |

*Primary Examiner*—Stephen P. Garbe

*Assistant Examiner*—Nova Stucker

[57] ABSTRACT

A plastic tamper indicating closure including a base wall, a peripheral skirt having an inner surface with interengaging threads engaging cooperating threads on a container such that said closure is removed by relative rotation. A first interrupted score line extends circumferentially about the skirt defining a weakened line by interrupted scores forming bridges and defining a wider connecting portion. The score line defines a tamper indicating band which has portions for engaging an annular bead on a container to inhibit removal of the closure such that the bridges must be broken to remove the closure. The tamper indicating band has a first axial score line adjacent the connecting portion that has its upper end intersecting the interrupted score line. A second axial score line is spaced circumferentially from the first axial score line and extending from the lower edge of the tamper indicating band and has an upper edge spaced from the weakened line of the band to define a strap such that the band successively expands at the second score line and the first score line as the closure is applied to a container and as the closure is removed, the strap yields and the weakened line is broken and the strap is severed at said second score line leaving the tamper indicating band attached to the closure by the connecting portion.

7 Claims, 3 Drawing Sheets

TAMPER INDICATING CLOSURE

This invention relates to tamper indicating closures.

BACKGROUND OF THE INVENTION

In providing tamper indicating closures, it is conventional to form a tamper indicating band that is connected to the closure by integral bridges and the band has means thereon for engaging an annular flange or the like on the container such that when the closure is unthreaded from the container the bridges are broken. Such closures are shown for example in U.S. Pat. Nos. 4,613,052, 4,721,218, 4,801,030, 4,801,031, and 5,080,246.

Another aspect of tamper indicating closures is to provide the band so that it is not completely severed from the closure when the closure is removed from the container. Such constructions are shown, for example, in U.S. Pat. Nos. 3,904,062, 4,033,472, 4,205,755, 4,530,436, 4,545,496, 4,458,821, 4,666,053, 4,720,018, 4,978,016 and 5,080,246.

Among the objectives of the present invention are to provide an improved tamper indicating closure which will accommodate the expansion of the tamper indicating band during application; wherein the tamper indicating band passes over the retention bead or flange on the container and fully seats on the container after closure application; wherein when the closure is removed from the container, the tamper indicating band is maintained on the closure; and wherein a portion of the connecting band provides a large gap giving more visual indication that the tamper indicating band has been severed from the container.

In accordance with the invention, the plastic tamper indicating closure comprises a base wall, a peripheral skirt having an inner surface with interengaging threads engaging cooperating threads on a container such that said closure is removed by relative rotation. A first interrupted score line extends circumferentially about the skirt defining a weakened line by interrupted scores forming bridges and defining a wider connecting portion. The score line defines a tamper indicating band. The band has portions for engaging an annular bead on a container to inhibit removal of the closure such that the bridges must be broken to remove the closure. The tamper indicating band has a first axial score line adjacent the connecting portion that has its upper end intersecting the interrupted score line. A second axial score line is spaced circumferentially from the first axial score line and extends from the lower edge of the tamper indicating band and has an upper edge spaced from the weakened line of the band to define a strap such that the band successively expands at the second score line and first score line as the closure is applied to a container and as the closure is removed, the strap yields and the weakened line is broken and the strap is severed at said second score line leaving the band attached to the closure by the connecting portion.

DESCRIPTION

Figure 1:
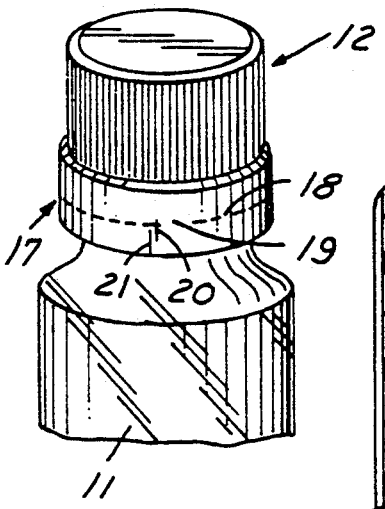
FIG. 1 is a fragmentary perspective view of a container package embodying the invention.
Figure 2:
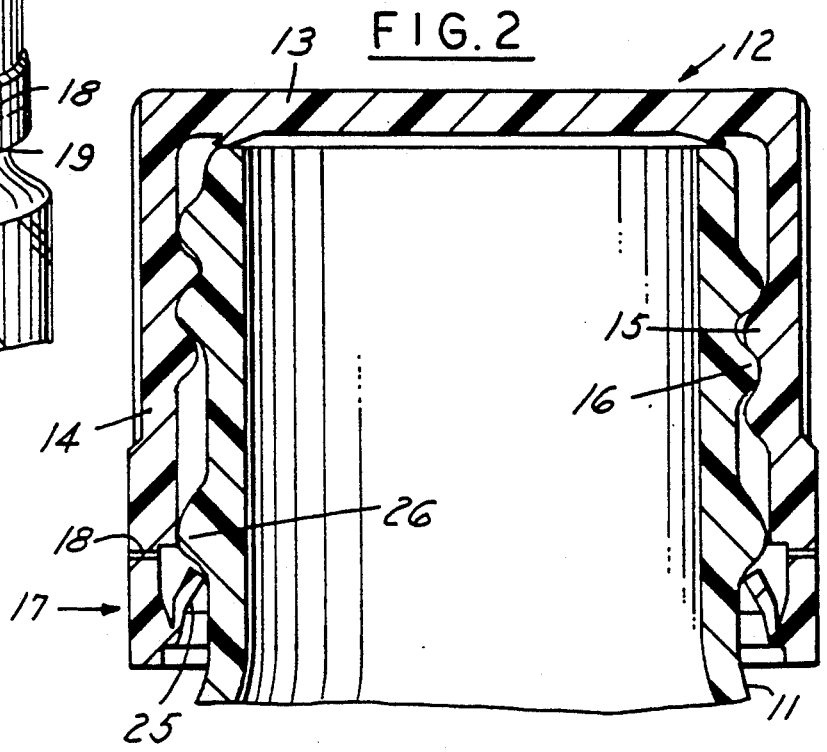
FIG. 2 is a fragmentary vertical sectional view of a portion of the package shown in FIG. 1.

Referring to FIGS. 1 and 2, a tamper indicating package 10 embodying the invention comprises a container 11 and a plastic closure 12, the container 11 being either a plastic or glass container. The plastic tamper indicating closure 12 comprises a base wall 13, an integral peripheral skirt 14 having threads 15 on the inner surface thereof for engaging complementary threads 16 on the container 11 and a tamper indicating band 17 connected by integral bridges that are formed by an interrupted score line 18 after the plastic closure has been molded either by injection molding or compression molding. The interrupted score line 18 defining the bridges comprises a plurality of circumferentially spaced scores which are equally spaced to form the bridges and at one portion defining a larger bridge 19.

Figure 3:
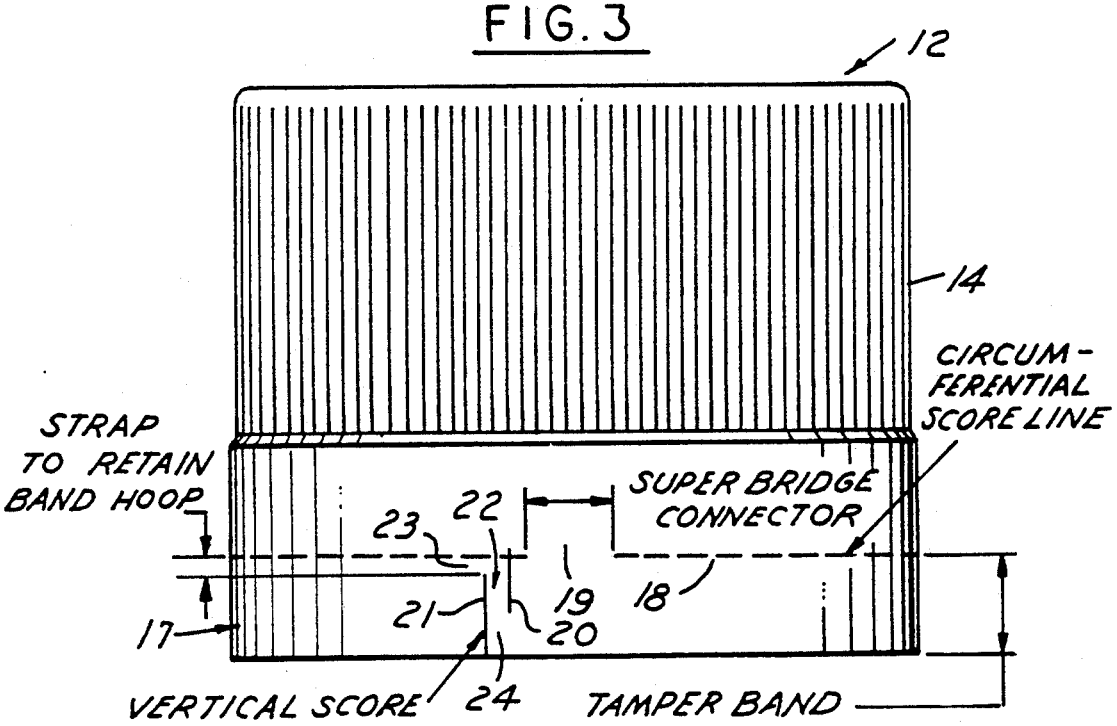
FIG. 3 is a fragmentary elevational view of the closure.

In accordance with the invention, the closure 12 includes a first axial score line 20 that is formed after molding and intersects at its upper end the interrupted score line 18 adjacent the wider connecting portion or bridge 19 defined by the horizontal score line 18 (FIG. 3).

The closure 12 in addition includes a second axial score line 21 which is spaced circumferentially from the first axial score line 20 away from the connecting portion 19 that terminates at its upper edge in spaced relation to the horizontal score line 18. The second score line 21 extends through the lower edge of the tamper indicating band 17. The first and second score lines 20, 21 define a strap 22 that normally extends vertically and is connected to the tamper indicating band 17 at its upper end at 23 and at its lower end at 24.

Figure 4:
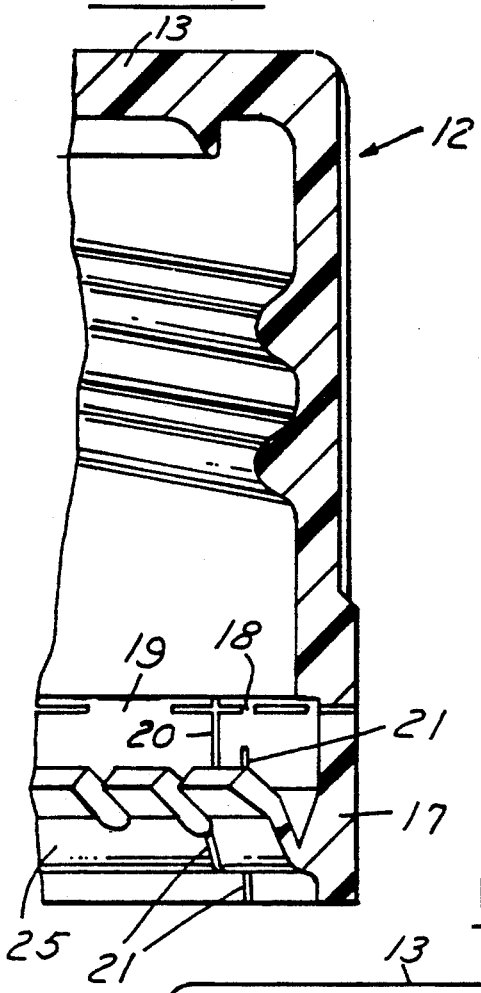
FIG. 4 is a sectional view on an enlarged scale of a portion of the closure.
Figure 5:
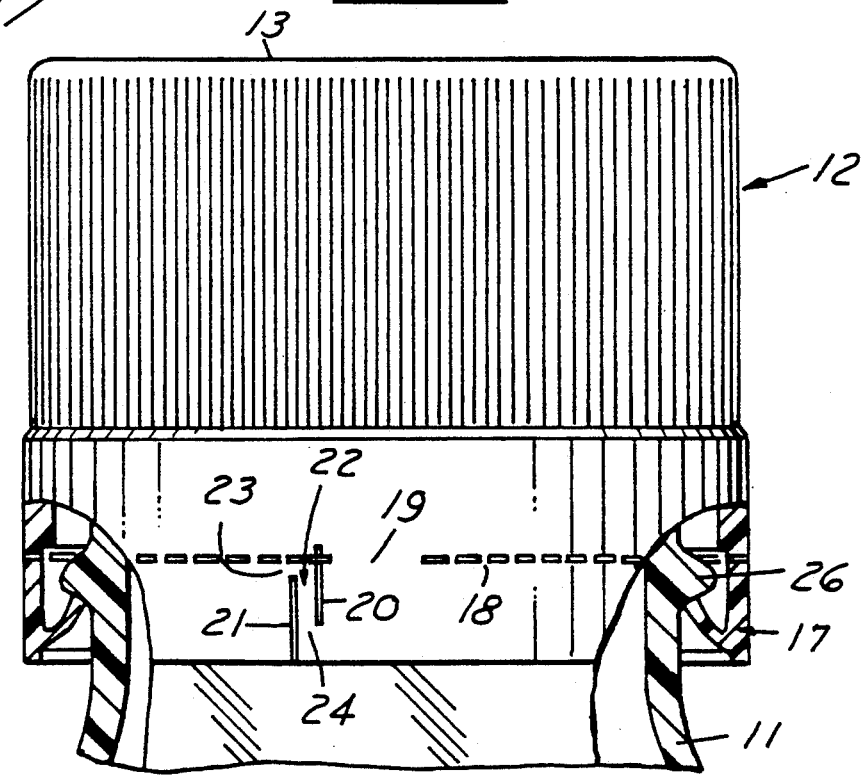
FIG. 5 is a part sectional view on an enlarged scale of the package.

As shown in FIGS. 2, 4 and 5, the tamper indicating band 17 includes interengaging means 25 on the band which engages an annular bead or flange on the container to retain the closure on the container. The interengaging means preferably comprises an annular flange extending axially upwardly and inwardly from the tamper indicating band toward the base wall of the closure and including a first continuous annular flange portion connected to the band by a hinge portion and a second portion which has segment portions, the free edges of which engages beneath a bead 26 on the container 11 when the closure is threaded onto the container. Such a tamper indicating closure in one form includes a plurality of segment portions and in another form includes a second continuous flange portion. The flange in both forms is bent intermediate its ends so that the second portion extends inwardly at a greater angle than the first continuous flange portion, all as shown in U.S. Pat. No. 5,090,788, incorporated herein by reference. Other types of tamper indicating bands may also be used as is well known in the art. As shown in FIG. 4, the axial score line 21 extends through the hinge portion and flange 25.

Figure 6:
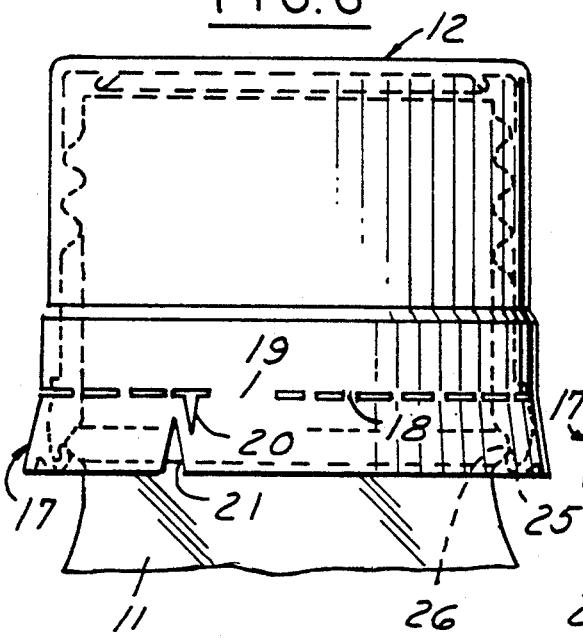
FIGS. 6–9 are fragmentary views showing successively applying and removing the closure.

Referring to FIG. 6, when the closure 12 is applied to the container 11, the vertical score lines 20, 21 open as the tamper indicating band expands and passes over the retention bead 26 on the container. This expansion makes the tamper indicating band more forgiving so that the tamper indicating band is less likely to be broken during the capping operation. The bridges and connecting bridge portion 19 maintains the band on the closure.

Figure 7:
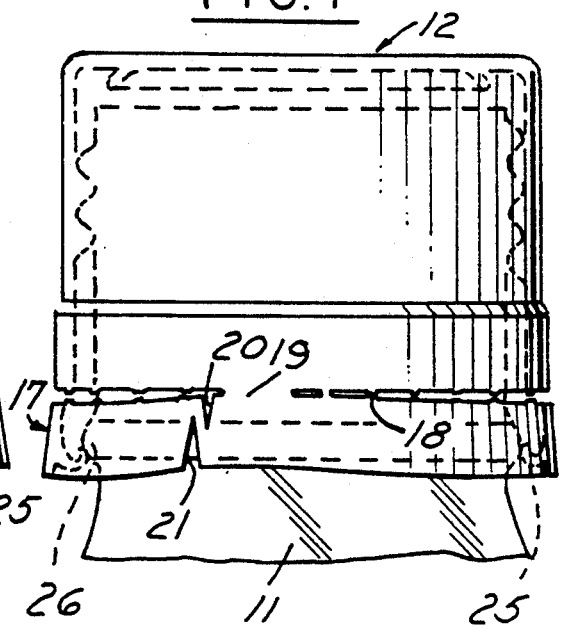

Referring to FIG. 7, upon removal of the closure 12 by unthreading the closure 12 from the container 11 the bridges formed by the interrupted score line are stretched and broken. During the initial rotation, the vertical score lines 20, 21 begin to open up or part.

Figure 8:
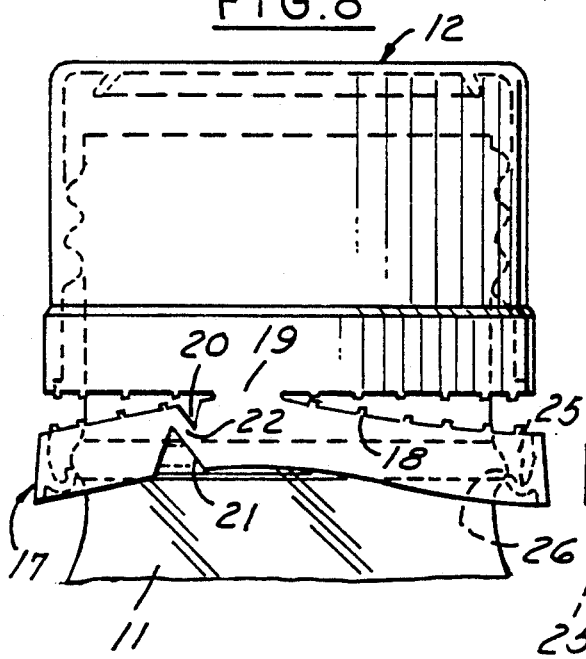

As further shown in FIG. 8, as the closure 12 is further unthreaded from the container, tension on the connecting strap 22 increases and the vertical score lines 20, 21 separate or widen.

Figure 9:
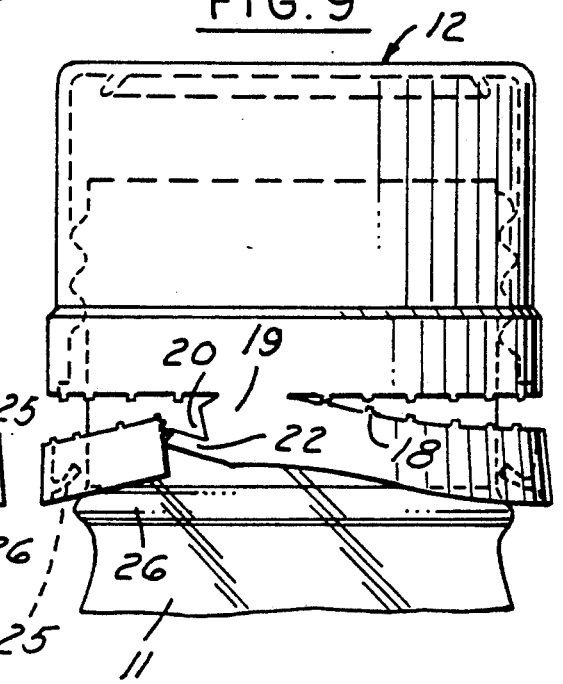

Finally, when the connecting strap 22 weakens and breaks from the remainder of the band as the closure is unthreaded, the strap 22 is distorted beyond its elastic limit to the position shown in the drawing (FIG. 9) The strap 22 is also severed at the upper edge of the band 17. This provides further visual evidence of the removal of the container. The band remains attached to the closure after removal from the container by the larger connecting portion or bridge 19.

It can thus be seen that there has been provided a tamper indicating closure which will accommodate the expansion of the tamper indicating band during application; wherein the tamper indicating band passes over the retention bead or flange on the container and fully seats on the container after closure application; wherein when the closure is removed from the container the tamper indicating band is maintained on the closure; and wherein a portion of the connecting band provides a large gap giving more visual indication that the tamper indicating band has been severed from the container.

I claim:

1. A plastic tamper indicating closure comprising a base wall, a peripheral skirt having an inner surface with thread means adapted to engage cooperating thread means on a container such that said closure is removed by relative rotation, an interrupted score line extending circumferentially about the skirt defining a weakened line by interrupted scores which form bridges and define a wider connecting portion, said score line defining a tamper indicating band having interengaging means thereon for engaging means on a container to inhibit removal to said closure such that the weakened line must be broken to remove said closure, a first axial score line on said tamper indicating band adjacent said connecting portion and having an upper end intersecting said interrupted score line and a lower end spaced from the lower edge of said tamper indicating band, a second axial score line on said tamper indicating band spaced circumferentially from said first axial score line and extending from the lower edge of said tamper indicating band and having an upper edge spaced from the upper end of said band to form a strap such that said band successively expands at said second score and first score line as the closure is applied to a container and as the closure is removed, said strap yields and the weakened line is broken and the strap is severed from the tamper indicating band leaving the tamper indicating band attached to said closure by said connecting portion.

2. The tamper indicating closure set forth in claim 1 wherein said first and second score lines are positioned such that said strap is deformed beyond its elastic limit when the closure is removed providing further visual evidence of the removal of the closure.

3. The tamper indicating closure set forth in claim 2 wherein said interengaging means on said closure for engaging means on a container comprises flange means extending upwardly and inwardly from said band, said second score line also extending through said flange means.

4. The tamper indicating closure set forth in any one of claims 1–3 including a container having bead means engaging said interengaging means.

5. The method of making a plastic tamper indicating closure comprising forming a plastic closure having a base wall, a peripheral skirt an inner surface with thread means adapted to engage cooperating thread means on a container such that said closure is removed by relative rotation, providing a first interrupted score line extending circumferentially about the skirt to define a weakened line by interrupted scores forming bridges and defining a connecting portion, said score line defining a tamper indicating band having means thereon for engaging means on a container to inhibit removal of said closure such that the weakened line must be broken to remove said closure, forming a first axial score line adjacent said connecting portion and having an upper end intersecting said interrupted score line, forming a second axial score line spaced circumferentially from said first axial score and extending from the lower edge of said band and having an upper edge spaced from the interrupted score line of said tamper indicating band to define a strap such that said band successively expands at said second score line and said first score line as the close is applied to a container and as the closure is removed, said strap yields, the bridges are broken and the strap is severed at said second score line leaving the tamper indicating band attached to said closure by said connecting portion.

6. The method set forth in claim 5 including the step of forming flange means comprising said interengaging means.

7. The method set forth in claim 6 including the step of forming said second score line such that it extends through said flange means.

* * * * *